United States Patent [19]

Parker

[11] 3,947,310

[45] Mar. 30, 1976

[54] EXTRA-WIDE NONWOVEN SHEETS

[75] Inventor: Phillip H. Parker, San Rafael, Calif.

[73] Assignee: Chevron Research Company, San Francisco, Calif.

[22] Filed: July 11, 1974

[21] Appl. No.: 483,200

[52] U.S. Cl. ..... 156/289; 156/62.2; 156/181; 156/306

[51] Int. Cl.[2] ..... D04H 3/03; D04H 3/08

[58] Field of Search ..... 156/62.4, 62.6, 166, 167, 156/180, 181, 204, 226, 227, 247, 289, 323, 344, 62.2, 306; 28/1 SM, 72 NW; 19/155, 161 R, 163

[56] References Cited

UNITED STATES PATENTS

| | | | |
|---|---|---|---|
| 2,736,676 | 2/1956 | Frickert, Jr. | 19/155 |
| 3,065,121 | 11/1962 | Andrews | 156/289 |
| 3,660,867 | 5/1972 | Watson | 28/72 NW |
| 3,692,618 | 9/1972 | Dorschner et al. | 28/72 NW |
| 3,765,971 | 10/1973 | Fleissner | 156/62.4 |
| 3,853,651 | 12/1974 | Porte | 28/1 SM |

*Primary Examiner*—William A. Powell
*Assistant Examiner*—Basil J. Lewris
*Attorney, Agent, or Firm*—G. F. Magdeburger; John Stoner, Jr.; S. Russell LaPaglia

[57] ABSTRACT

Extra-wide, heat-sealed nonwoven sheets of thermoplastic synthetic polymer monofilaments are prepared by folding said sheets in layers with heat-insulating fabric between said layers before contact with heating and pressing means to effect heat sealing, followed by removal of the insulating fabric and heat sealing of the fold areas.

5 Claims, 3 Drawing Figures

EXTRA-WIDE NONWOVEN SHEETS

BACKGROUND OF THE INVENTION

1. Field of the Invention

This ivention pertains to the preparation of extra-wide nonwoven sheets. More particularly, the invention pertains to a process for preparing extra-wide, heat-sealed nonwoven sheets of thermoplastic synthetic polymer monofilaments.

2. Description of the Prior Art

Nonwoven sheets are prepared in general by spinning continuous monofilaments of spinnable thermoplastic synthetic polymers, drawing the freshly spun filaments to improve the tensile strength of the filaments, and depositing them on a collecting surface. The mats or batts of the intermingled monofilaments on the collecting surface are bound, for example, by heat sealing in an arrangement of heating and pressing rollers, belts, etc. See, for instance U.S. Pat. No. 3,630,816, the disclosure of which is hereby incorporated by reference.

The heat-sealed nonwoven sheets of thermoplastic synthetic polymer monofilaments are highly suitable as carpet backing. See, for instance, U.S. Pat. No. 3,360,421. However, heat-sealing machines are limited in width because of practical limitations on the size of heating and pressing rollers, belts, etc. Also, the close tolerances required in such heating and pressing operations make it difficult to work with large-size surfaces. Attempts to piece smaller sheets together to form extra-wide sheets are unsatisfactory, because of the problem of seams.

For these reasons the production of continuous extrawide nonwoven sheets has been a problem in the art.

SUMMARY OF THE INVENTION

In accordance with the present invention there is provided a process for preparing extra-wide, heat-sealed nonwoven sheets of thermoplastic synthetic polymer monofilaments which comprises folding said nonwoven sheets in layers, inserting heat-insulating fabric between said layers, wrapping additional heat-insulating fabric around fold areas connecting said layers, contacting the folded and insulated nonwoven sheet with heating and pressing means to effect heat sealing of said nonwoven sheet, unfolding the heat-sealed nonwoven sheet, removing the insulating fabric and contacting the fold areas with heating and pressing means to effect heat sealing of said nonwoven sheet in said fold areas.

The heat-sealed nonwoven sheets prepared in accordance with the invention are much wider than those obtained heretofore using the conventional heating and pressing means of the art. Objectionable creases and ridges due to seams joining smaller sheets together are effectively eliminated.

BRIEF DESCRIPTION OF THE DRAWINGS

The accompanying drawing is composed of three figures.

DESCRIPTION OF THE PREFERRED EMBODIMENTS

Figures 1, 2, 3:
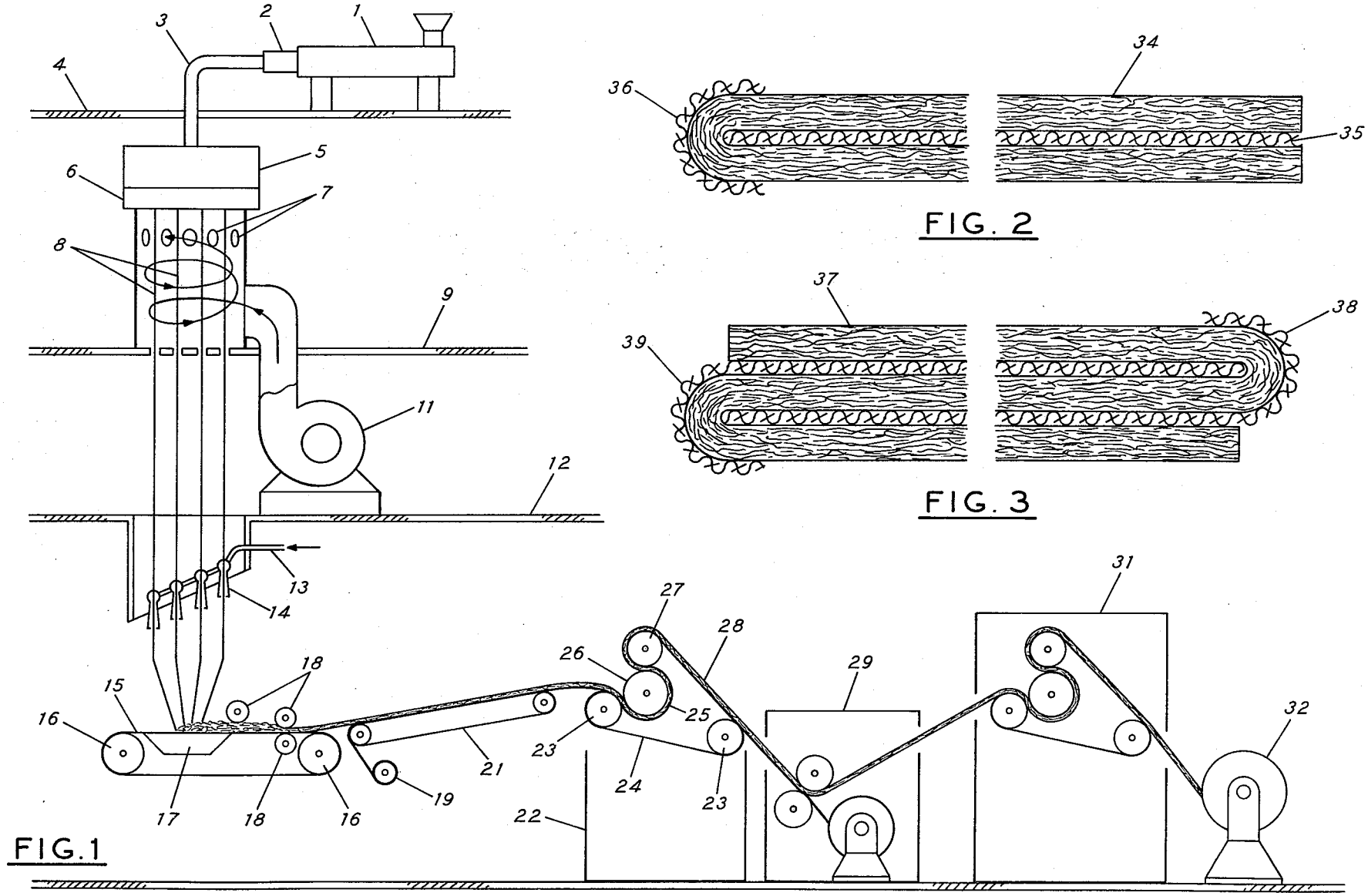
FIG. 1 shows apparatus for preparing heat-sealed nonwoven sheets of thermoplastic synthetic polymer monofilaments.
FIGS. 2 and 3 show the nature of the folded and insulated mat or batt of intermingled thermoplastic synthetic polymer monofilaments which are heated and pressed to effect heat sealing.

Referring now to FIG. 1, the production of extra-wide, heat-sealed nonwoven sheets of thermoplastic synthetic polymer monofilaments is shown by schematic arrangement using four different operating levels. Thermoplastic synthetic polymer material is placed in heater and extruder 1 through a hopper. The heated and extruded polymer is then passed through mixing chamber 2 out heated pipe 3. All of the foregoing takes place on the top level 4.

The mixed and heated thermoplastic polymer is conveyed through heated pipe 3 to metering pumps 5. From metering pumps 5, the heated theremoplastic polymer is passed through an arrangement of screens and dies 6. Bundles of monofilaments are drawn through the screens and dies as bundles 8. After the thermoplastic synthetic polymer is passed through the screens and dies, air cooling is effected by circulation through appertures 7 passing around fiber bundles 8. The bundles are drawn down through appertures in the next-lower level of operation 9, where blower 11 to provide air for cooling the fiber bundles is located.

The fiber bundles of thermoplastic synthetic polymer monofilament are drawn through the next-lower level 12 by heated air 13 under pressure of about 20 atmospheres through orifice 14. After the bundles of synthetic polymer monofilament leave the orifice, they are impinged on collecting screen 15, which is moved as a continuous conveyor belt over rollers 16. A vacuum 17 is applied to aid in collecting the fiber bundles of randomly intermingled synthetic polymer monofilaments, which are formed into mats or batts with the use of additional rollers 18.

The mat or batt of collected randomly intermingled thermoplastic synthetic polymer monofilaments is continuously folded and heat-insulating fabric is inserted between and around the folds of the mat or batt by means of rollers 19 and conveying apparatus 21. The folded and insulated mat or batt is then passed into heating and sealing means 22 over heated rollers 23 and presser conveyor belts 24 and 25. Additional heating and pressing are accomplished at roller 26 and roller 27, and the heat-sealed web 28 is withdrawn and passed into zone 29, where it is unfolded and the insulating fabric removed therefrom. Following zone 29, the unfolded fiber web is passed into a second heat-sealing machine 31 where the fold areas of the nonwoven sheet are heated and pressed to effect heat sealing. The heat-sealed nonwoven sheet is then withdrawn and wound on take-up reel 32.

Turning now to FIG. 2, the arrangement of folded mat or batt of synthetic polymer monofilament and insulating fabric can be seen in a schematic section view. In FIG. 2 the mat or batt 34 has been folded with a single fold and insulating fabric 35 has been inserted between layers. Additional heat-insulating fabric 36 has been wrapped around the fold area.

Turning now to FIG. 3, a schematic section view of a different arrangement of synthetic polymer monofilament mat or batt and insulating fabric is shown. In this view the mat or batt 37 is folded twice and two insulating fabric layers 38 and 39 are employed.

The schematic section drawings of FIG. 2 and FIG. 3 illustrate the manner in which nonwoven sheets may be obtained which are several folds wider than the heated roller and presser means.

The heating and pressing means used in the present process, as indicated in the preceding description of the drawing, may be employed in tandem to heat-seal first one half of the folded and insulated nonwoven sheet and then the other half. Also, the heated rollers and/or presser belts may be embossed, if desired, to provide a particular type of calendered surface including a variety of texture-like effects. The size of the heat-sealing apparatus may vary considerably, depending on the width of the heated rollers and pressing belts. Such heat-sealing machines having widths as great as 7–8 feet are practical, and with the folding and insulating process of the present invention are suitable for the production of widths of nonwoven sheet as great as 15 feet, which are needed for use as carpet backing and the like.

The heat-insulating fabric employed in the process of the invention may be applied by hand. However, it is more practical in the usual operation to include machinery in the production line for automatically applying the insulating fabric prior to heating and pressing and thereafter removing the insulating fabric, for further use, if desired. Any suitable arrangement of supply reels, folding rollers and takeup reels may be used for the inserting and folding applications of the insulating fabric.

The oriented monofilaments of synthetic polymer which are used in the method of this invention have cross-sections dependent upon the particular shape of the orifices or dies from which they are spun. Also, the extent of drawing and orientation has an effect on the cross-section shape. Usually the filament emerging from the die will range in cross-sectional area size from about 0.004 to 4.0 $mm^2$ down to a cross-sectional area as small as about 0.00005 to 0.008 $mm^2$. The drawing is done after the filaments are partially cooled and the polymer in a partially crystalline state to produce a desired amount of orientation.

Although various means for drawing the synthetic polymer monofilaments may be employed, it is common to feed the freshly spun monofilaments, usually in a bundle of about 5–500, into the main chamber of a pneumatic jet. Air or other inert gases may be used as a gaseous drawing medium, usually at a velocity of about 200–800 m/second. The air or other inert gas picks up the monofilament bundle and draws it at speeds in excess of 1500 m/minute up to the speed which would result in breakage of the filament. The drawn monofilaments are laid down onto a collecting surface as they emerge from the pneumatic jet. The collecting surface may be a screen conveyor belt having a vacuum area under the screen to collect the monofilament. As the conveyor belt screen moves away from the collecting zone, the filaments are ordinarily laid down in a random pattern as a web in the shape of a mat or batt, which is then subjected to heating and pressing to effect heat sealing in accordance with the present invention.

The thermoplastic synthetic polymers which may be used in the present invention may be any polymers which are suitable for spinning and forming into continuous monofilaments. Such polymers include crystalline polypropylene, crystalline polyethylene, poly-4-methyl-1-pentene, poly-2-pyrrolidone, polycaprolactam, polyvinyl chloride, polyesters such as polyethyleneterephthalate, polyamides such as polyhexamethyleneadipamide, and the like.

The heat-insulating fabric may be any fabric material capable of providing sufficient insulation to prevent undesired bonding between the layers of nonwoven sheet which are being heat sealed. Woven cotton cloth, woven wool cloth, or woven cloth of synthetic materials such as rayon or nylon may be used. Nonwoven cloth such as wool felts and the like may also be used.

The following example illustrates the preparation of extra-wide, heat-sealed nonwoven sheets of thermoplastic synthetic polymer monofilaments in accordance with the present invention.

EXAMPLE

A sample of 4-ounce/$yd^2$ spin-drawn polypropylene fiber batt which was 2 feet wide was folded in half. A piece of about 6-oz/$yd^2$ was placed between the layers for insulation.

Two pieces of rayon 4 inches wide were wrapped around the fold to insulate it. The batt was next passed through the heat-sealing machine at a speed of 2 yards/minute. The hot roll was at 170°C., and the hydraulic pressure on the roll was 150 atmospheres. First one side and then the other of the batt was passed through to contact the hot roll and become heat sealed. A layer of cloth could be placed between the hot roll and the batt to give it texture, if desired. Finally the batt was opened up, and the fold did not have a crease. The opened sample was then passed through the heat-sealing machine to seal the fold area which had been insulated in the first crease. Therefore, a heat-sealed nonwoven sheet, twice as wide as the heat-sealing machine, was made by this folding and insulation technique.

The heat-sealing machine used in the above experiment consisted of a heated metal roll about 12 inches in diameter. It had a traveling rubber-covered belt which pressed the fiber batt to be sealed against the hot roll and then transported the batt around the roll.

Using the above technique, a separate smaller heat-sealing machine may be used to seal the fold area after the insulating fabric is removed.

While the character of this invention has been described in detail, this has been done by way of illustration only and without limitation of the invention. It will be apparent to those skilled in the art that modifications and variations of the illustrative examples may be made in the practice of the invention within the scope of the following claims.

What is claimed is:

1. The process for preparing extra-wide, heat-sealed nonwoven sheet of thermoplastic synthetic polymer monofilaments which comprises folding said nonwoven sheet in layers, inserting heat-insulating fabric between said layers, wrapping additional heat-insulating fabric around fold areas connecting said layers, contacting the folded and insulated nonwoven sheet with heating and pressing means to effect heat sealing of said monofilaments in each layer of said nonwoven sheet, unfolding the heat-sealed nonwoven sheet, removing the insulating fabric and contacting the fold areas with heating and pressing means to effect heat-sealing of said monofilaments in said nonwoven sheet in said fold areas.

2. The process in accordance with claim 1 wherein the heating and pressing means comprise a heated roller.

3. The process in accordance with claim 2 wherein the nonwoven sheet is several folds wider than the heated roller.

4. The process in accordance with claim 3 wherein the thermoplastic synthetic polymer is isotactic solid polypropylene.

5. The process in accordance with claim 4 wherein the heat-insulating fabric is rayon cloth.

* * * * *